US007520665B1

(12) United States Patent
Nunes et al.

(10) Patent No.: US 7,520,665 B1
(45) Date of Patent: Apr. 21, 2009

(54) MARINE INSTRUMENTS

(75) Inventors: Brendon G. Nunes, Ajax (CA); Gregory J. T. Lowe-Wylde, Ajax (CA)

(73) Assignee: Trintec Industries Inc., Ajax, Ontario (CA)

( * ) Notice: Subject to any disclaimer, the term of this patent is extended or adjusted under 35 U.S.C. 154(b) by 1998 days.

(21) Appl. No.: 09/702,877

(22) Filed: Nov. 1, 2000

(51) Int. Cl.
*G04B 37/00* (2006.01)

(52) U.S. Cl. ..... 368/276; 368/11; 368/278; 368/291

(58) Field of Classification Search ..... 368/11, 368/291, 276, 278; 73/384
See application file for complete search history.

(56) References Cited

U.S. PATENT DOCUMENTS 4,201,090 A * 5/1980 Davidson ..... 73/431
5,592,442 A * 1/1997 Nishikawa et al. ..... 368/11
5,598,383 A * 1/1997 Li ..... 368/291
5,610,878 A * 3/1997 Pretat ..... 368/276
5,827,973 A * 10/1998 Takeda ..... 73/756
5,940,350 A * 8/1999 Booty, Jr. ..... 368/276
6,278,659 B1 * 8/2001 Yokouchi ..... 368/11

OTHER PUBLICATIONS 1997-1998 Weems & Plath "Marine Products Catalog", cover and pp. 1 and 23-42.
Belfort Instruments web site "Belfort Aneroid Barometer—Model 6079", admitted prior art.
GenPore web site "Innovation in Porous Plastics", admitted prior art.
Porex web site "Standard Tube Products", admitted prior art.

* cited by examiner

*Primary Examiner*—Edwin A. Leon
*Assistant Examiner*—Thanh S Phan
(74) *Attorney, Agent, or Firm*—Nixon, Vanderhye P.C.

(57) ABSTRACT

A marine instrument, such as a clock, barometer, or thermometer, has a face having indicia associated with the face, an instrument movement, and at least one hand having a direct or indirect connection to the movement and positioned to move with respect to the face, or a display connected to an electronic movement. The components are encased within a casing that is water tight to at least 12 inches (e.g. about 30 feet) of water. A vent, such as a porous plastic plug, allows the passage of air in and out of a substantially water-tight volume containing the movement, but precludes water passage up to the rated pressure. The casing may be formed by first and second aluminum portions which have flange and groove (bayonet) readily releasable connections, and an O-ring seal, and a third aluminum portion opposite the first portion and making a seal, including with a lens, and at least one O-ring, with the second portion and releasable fasteners holding the third portion to the second portion with the lens covering the face.

18 Claims, 6 Drawing Sheets

Fig. 7
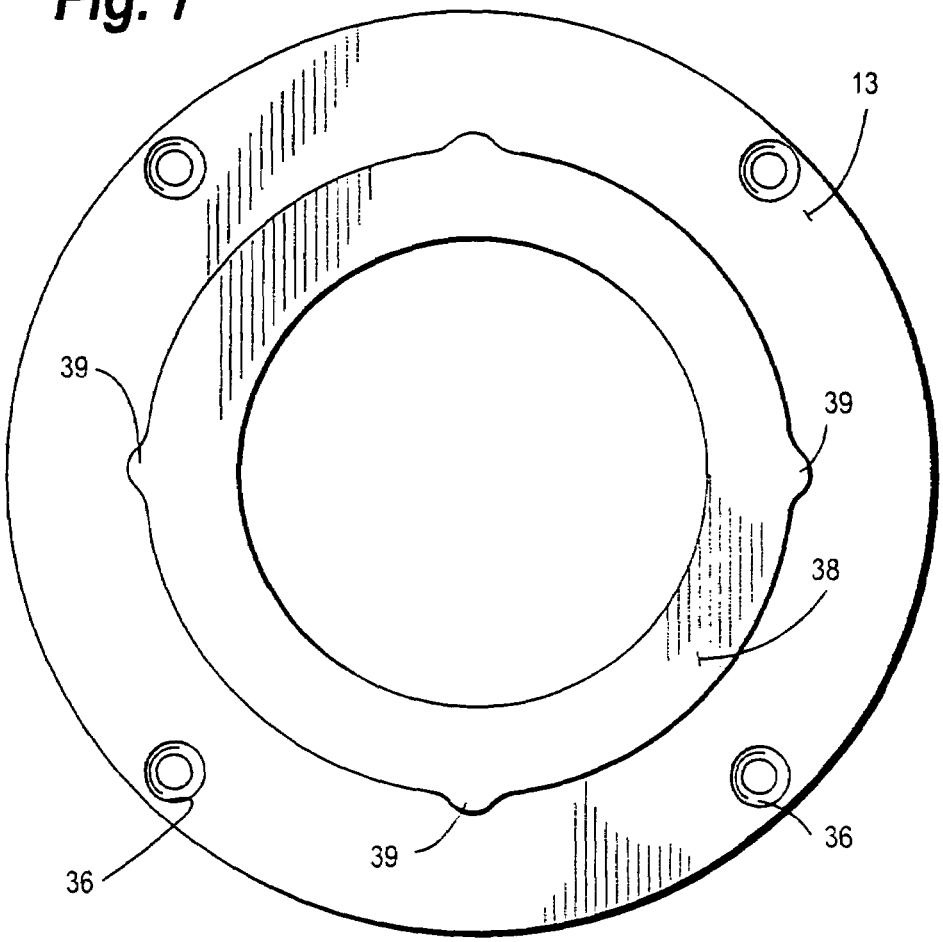
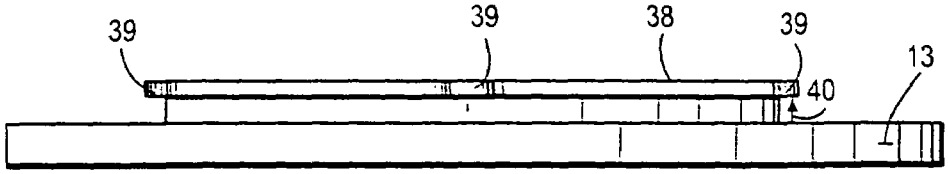
Fig. 8

MARINE INSTRUMENTS

BACKGROUND AND SUMMARY OF THE INVENTION

Conventional marine instruments, such as clocks, barometers, and thermometers which are designed to be used in the cabins or other areas of boats, ships, and other marine vessels, or at dock or other areas adjacent bodies of water, oftentimes have no special adaptation for marine use, are typically permanently mounted, and if adapted for marine use often have complex sealing arrangements. According to the present invention a marine instrument is provided which overcomes the problems associated with conventional marine instruments. The marine clocks, barometers, thermometers, or like instruments, according to the present invention are substantially water-tight, being water-tight to at least about 12 inches of water, and typically about 30 feet of water or more, so that no normal amount of splashing, or even capsizing, will harm the operability of the marine instrument. Further the marine instrument is mounted so that it can be easily removed from the marine vessel, dock, or the like, leaving just the base behind, and can be just as easily reattached to the base when desired. Despite the water-tight construction of the device according to the invention, it is accurate and maintains accessibility for repair or replacement of components, and has appropriate venting.

The marine instruments according the present invention preferably have faces having indicia associated therewith (e.g. indicia thereon), and at least one hand operatively connected to an electric, mechanical, or electro-mechanical instrument movement so as to move with respect to the face. However the face may have a digital, or like, display, an electronic movement may be operatively connected to the display. The structure according to the invention may be made in almost any suitable size for conventional marine instruments, for example having a face diameter of between about two and ten inches.

According to one aspect of the present invention there is provided a marine instrument comprising: A face having indicia associated therewith. An electrical, mechanical, electronic, or electro-mechanical instrument movement. At least one hand operatively connected to the movement and positioned to move with respect to the face. A casing water tight to at least about 12 inches of water, the movement, face and at least one hand disposed within the water-tight casing. And, a first portion of the casing which facilitates mounting of the casing on a surface, and a second portion of the casing which is readily movably mounted with respect to the first portion to allow access to the movement when the first and second portions are in a first position, and precluding access to the movement when the first and second portions are in a second position.

Typically a substantially water-tight volume is defined between the first and second portions when in the second position, and the instrument further comprises a vent substantially continuously allowing passage of air in and out of the volume but precluding passage of water into the volume under a pressure of at least 12 inches of water. The vent preferably comprises at least one plug of porous plastic, for example having a porosity (average pore size) of between about one-twelve microns, and the plug typically has a small diameter, less than an inch, typically even less than a half of inch. The casing may be water-tight to at least a pressure of about 30 feet of water, so that no conventional splashing or other environmental conditions in a conventional marine vessel will adversely affect the operability and accuracy of the instrument.

Typically the first and second portions of said casing are movably mounted with respect to each other by a plurality of flange and groove connections (a bayonet connection), and the instrument further comprises at least one seal mounted on at least one of the first and second portions for providing a substantially water-tight seal between the first and second portions in the second position. The at least one seal preferably comprises one or more O-rings, including at least one O-ring outward of the flange and groove connections (bayonet connection).

In one embodiment the movement comprises a battery powered movement, and wherein the face comprises a clock face having clock indicia thereon, and wherein the at least one hand comprises at least two hands. In another embodiment the movement comprises a barometer movement, and the face comprises a barometer face having barometer indicia thereon; and the instrument further comprises a manually movable indicator cooperable with the barometer face. In all embodiments the casing may further include a conventional inclination indicator mounted in the casing adjacent the face and visible from exterior of the casing when viewing the face.

According to another aspect of the invention the casing further comprises a third portion on the opposite side of the second portion from said first portion, and a lens, the lens covering the face and being held in substantially water-tight relationship with at least one of the face and the second portion by the third portion; and the third portion may be mounted by a plurality of releasable mechanical fasteners to the second portion. Typically the first, second and third portions of the casing are of aluminum and the lens if of transparent glass or plastic.

According to another aspect of the present invention there is provided a marine instrument comprising: A face having a display. An electrical, mechanical, electronic, or electro-mechanical instrument movement, operatively connected to the display. A casing water tight to at least about 12 inches of water, the movement and face disposed within a substantially water-tight volume of the water-tight casing. And, a vent substantially continuously allowing passage of air in and out of the volume but precluding passage of water into the volume under a pressure of at least 12 inches of water. The display may be at least one hand movable across indicia mounted on or otherwise associated with the face, or a digital display may be provided connected to an electronic movement.

The vent preferably comprises at least one plug of porous plastic, as described above. Typically the casing is water-tight, and the vent precludes passage of water into the volume, to at least a pressure of about 30 feet of water. The casing typically comprises first, second, and third portions sealed to each other by O-ring seals, with the second portion substantially tubular and between the first and second portions. The first and second portions are typically readily releasably held together by a plurality of flanges and grooves (i.e. a bayonet connection), and the second and third portions are held together by releasable mechanical fasteners.

According to yet another aspect of the present invention there is provided a marine instrument comprising: A face having a display. An electrical, mechanical, electronic, or electro-mechanical instrument movement. A casing water tight to at least about 12 inches of water and comprising a body portion, a cover portion, and a lens portion. The casing body portion containing therein or mounting thereon the movement and face. And, the casing body portion covered by the lens portion and the cover portion, and the cover and lens portions making a substantially water-tight seal with the body portion, and the face and display visible from outside the casing through the lens.

In one embodiment the movement comprises a barometer movement, and wherein at least one of the face and the display comprises barometer indicia. In another embodiment the movement comprises a battery powered movement, and the face comprises a clock face having clock indicia thereon, and further comprising at least two hands movable with respect to face clock indicia. The instrument may further comprise an inclination indicator mounted in the casing adjacent the face and visible from the exterior of the casing when viewing the face. Also the substantially water-tight seal between the body portion and the cover and lens portions is provided by at least one O-ring seal.

It is the primary object of the present invention to provide an effective and desirable marine instrument, such as a clock, barometer, or thermometer. This and other objects of the invention will become clear from an inspection of the detailed description of the invention, and from the appended claims.

BRIEF DESCRIPTION OF THE DRAWINGS

FIG. 7 is a top plan view of the bottom portion (base) of the casing of the clock of FIGS. 1A and 1B, and FIG. 8 is a side view of the casing portion of FIG. 7;

DETAILED DESCRIPTION OF THE DRAWINGS

Figure 1A:
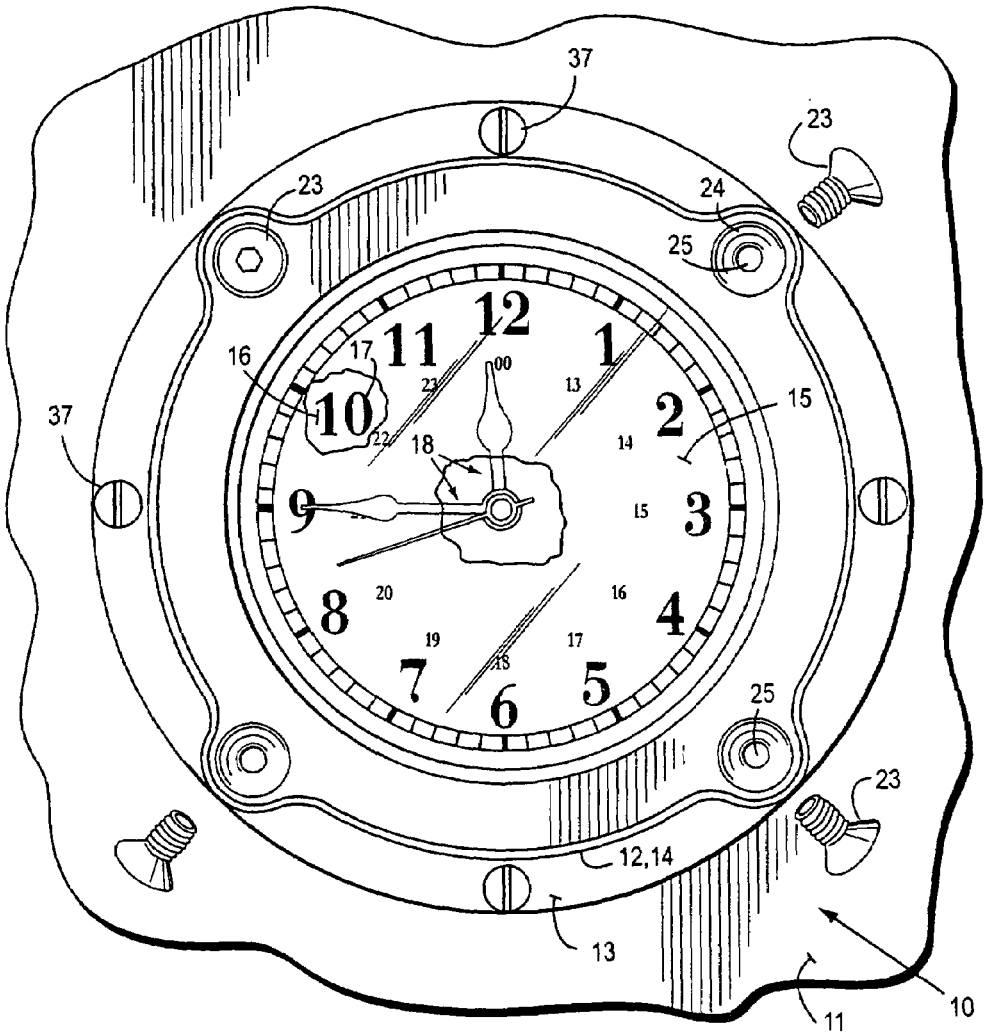
FIG. 1A is a top plan view, with portions cut away for clarity of illustration and with some of the fasteners removed, of an exemplary marine instrument in the form of a clock according to the present invention.
Figure 1B:
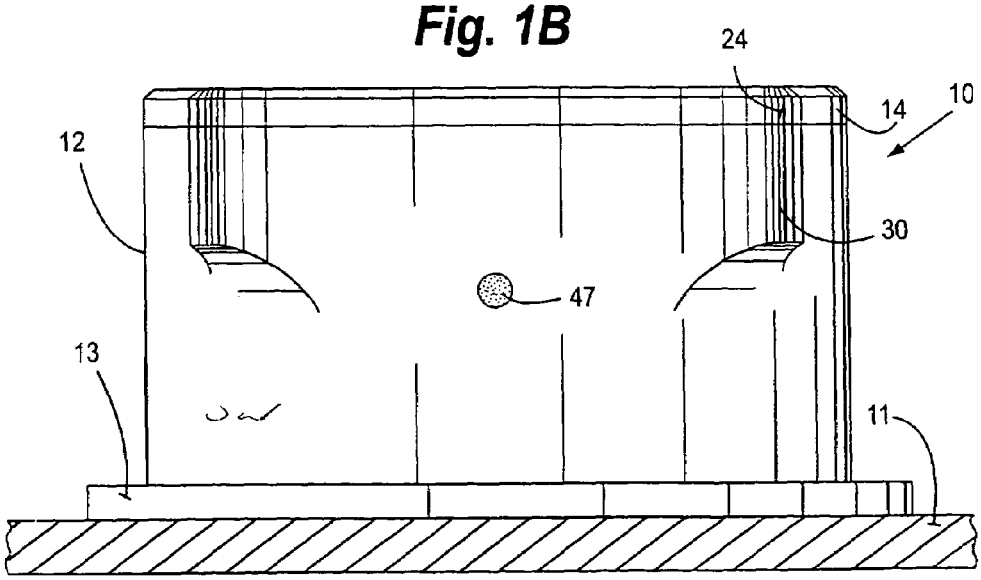
FIG. 1B is a side view of the clock of FIG. 1A.

The following elements refer to various structures illustrated in the exemplary embodiments shown in FIGS. 1A through 14.

| Reference No. | Structure |
|---|---|
| 10 | Marine instrument in the form of a clock |
| 11 | Surface for mounting the marine instrument 10 |
| 12 | Main body portion (second portion) of the casing of the instrument 10 |

-continued

| Reference No. | Structure |
|---|---|
| 13 | First portion, mounting base, of the casing of the instrument 10 |
| 14 | Third portion, or cover, of the casing of the instrument 10 |
| 15 | Lens |
| 16 | Instrument (clock) face |
| 17 | Indicia on the clock face 16 |
| 18 | Instrument/clock hands |
| 19 | Movement (clock movement) |
| 20 | Conventional clock movement structure for rotating the hands 18 |
| 21 | Battery for powering the structure 20 |
| 22 | Inner surface of the casing portion 12 defining the volume containing the movement 19 |
| 23 | Removable fasteners for fastening the cover 14 to the casing body 12 |
| 24 | Mounting tabs of the cover 14 |
| 25 | Fastener 23-receiving openings in the tabs 24 |
| 26, 27 | Surfaces of the inner mounting ring of the cover 14 |
| 28 | Ridge extending outwardly from and between the surfaces 26, 27 and engaging lens 15 |
| 30 | Mounting tabs on the casing portion 12 corresponding to the tabs 24 |
| 31 | Tapped holes in the tabs 30 for receipt of the fasteners 23 |
| 32 | O-ring seal between the portions 12, 15 |
| 33 | Top surface of casing portion 12 |
| 34 | Integral mount for the face 16 |
| 36 | Openings in the first casing portion/base 13 of the instrument 10 |
| 37 | Screw-threaded fasteners passing through the openings 36 for mounting the base 13 to the surface 11 |
| 38 | Flange mounting ring |
| 39 | Plurality of spaced flanges |
| 40 | Spacing of the flanges 39 from the base 13 |
| 42 | Bottom surface of the casing portion 12 |
| 43 | O-ring seal for sealing between the casing portions 12, 13 |
| 44 | Entrance to the flange-cooperating grooves 45 |
| 45 | Flange cooperating-grooves in the wall 22 of the casing portion 12 |
| 46 | Stop edges of grooves 45 |
| 47 | Porous plastic plug vent |
| 50 | Barometer instrument |
| 51 | Barometer instrument casing extension |
| 52 | Inclination indicator |
| 53 | Ball component of inclination indicator 52 |
| 54 | Indicia for inclination indicator |
| 55 | Cut out in back of cover 114 for inclination instrument 52 |
| 57 | Manually movable indicator for barometer 50 |
| 58 | Slide portion of indicator 57 |
| 59 | Pointer portion of indicator 57 |
| 60 | Groove in cover 114 for indicator slide 58 |
| 112-119, 123-125 | Components of barometer 50 comparable to the structures 12-19 and 23-25 of the clock instrument 10 |

Marine instruments according to the present invention may be in the form of clocks, thermometers, barometers, or like indicators. FIGS. 1 through 11 show one embodiment of a marine instrument according to the present invention, generally by reference numeral 10, in the form of a clock. The clock 10 is adapted to be readily releasably mounted to a surface 11. The surface 11 may be a wall, instrument or equipment panel, partition, substantially horizontal surface, or any of a wide variety of other types of surfaces that typically would be provided in a ship, boat, or other marine vessel, or at a shore location near water (e.g. at a dock).

The clock 10 includes a casing which preferably has four main components, a main substantially tubular body portion (a second portion) 12, a mounting base (first portion) 13, a cover (third portion) 14, and a lens 15. The components 12 through 15 are assembled together so that the casing is water-tight at least to about 12 inches of water, and in fact the construction according to the invention allows the casing to remain water-tight even to about 30 feet of water. With that level of water tightness, the typical splashing of water onto a boat, or at a dock, etc., has no affect on the operation of the operative components of the clock 10.

While the casing components may be made of any suitable material, it is desirable to make the portions 12 through 14 of aluminum (which may be anodized), while the lens 15 is made of glass or transparent plastic.

Figure 6:
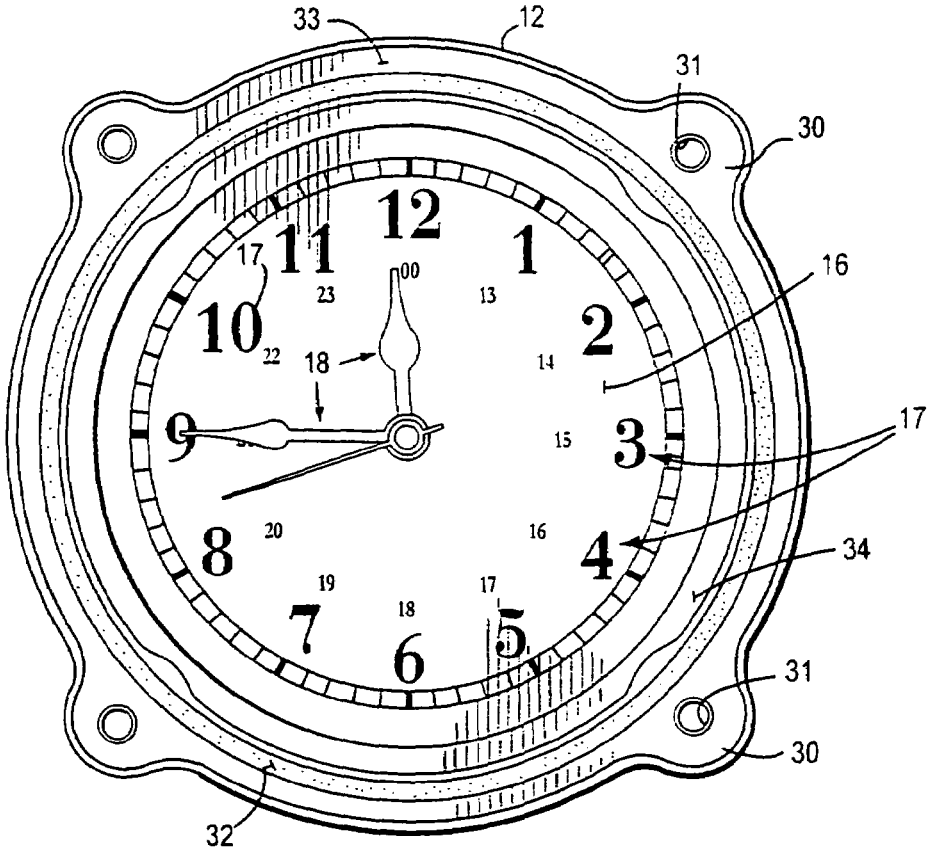
FIG. 6 is a top plan view of the casing main body portion of the clock of FIGS. 1A and 1B with the cover and lens removed.

The clock 10 also comprises a face 16 (e.g. of plastic; or a laminate with paper as the top layer) having indicia 17 associated therewith. Preferably the indicia 17 is imaged directly on the clock face 16, as seen in FIGS. 1A and 6. The clock 10 preferably comprises at least two hands 18 associated therewith, such as an hour hand and minute hand (and preferably second hand) mounted to traverse the indicia 17, as is conventional.

The clock 10 also comprises (see FIG. 9) a conventional movement 19. The movement may be mechanical, electro-mechanical, electrical, or electronic. In the embodiment illustrated the movement 19 comprises an electro-mechanical device 20 powered by a conventional dry cell battery 21, the movement 20 operatively connected to the hands 18 in a conventional manner so as to move the hands 18. Any conventional movement 19 may be utilized. Where the movement 19 is electronic, the display on the face 16 may be—instead of the indicia 17 and the hands 18—a digital display, as is also conventional per se.

The movement 19 is contained within a substantially water-tight volume during use of the clock 10, i.e. within the volume defined by the internal periphery 22 of the casing second portion 12.

In the embodiment illustrated most clearly in FIGS. 1A, 1B, 2, 8, and 9, the cover 14 is readily releasably connected to the body portion 12 of the casing by mechanical fasteners, such as the screws 23 (see FIG. 1A). The cover 14 may have a plurality (e.g. two to ten or even more) of tabs 24 each with through-extending openings 25 therein through which the screws 23 pass. The tabs 24 are aligned with a like plurality of tabs 30 formed on the substantially tubular body 12 of the casing, the tabs 30 having tapped holes 31 (see FIG. 6) therein into which the screws 23 are threaded.

The cover 14 holds the lens 15 in contact with the casing portion 12 either directly or through the lip 34 of the face 16 mounting the face 16 in the tubular interior of the casing portion 12. In order to provide an effective substantially water-tight seal between the cover 14 and the casing body 12, preferably one or more O-rings are provided.

Figure 2:
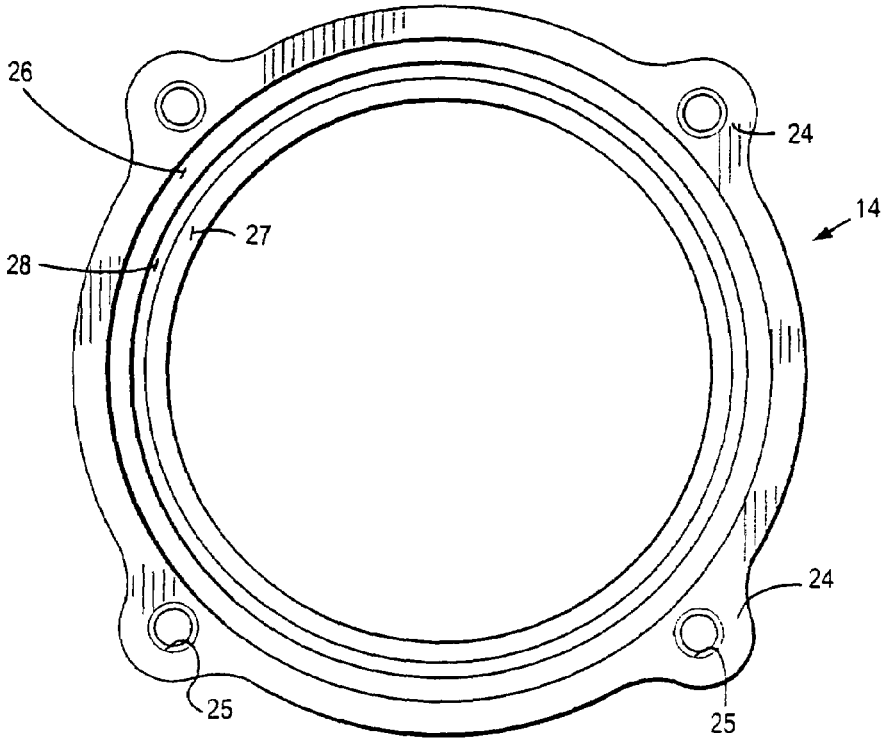
FIG. 2 is a bottom plan view of the cover of the clock of FIGS. 1A and 1B.
Figure 4:
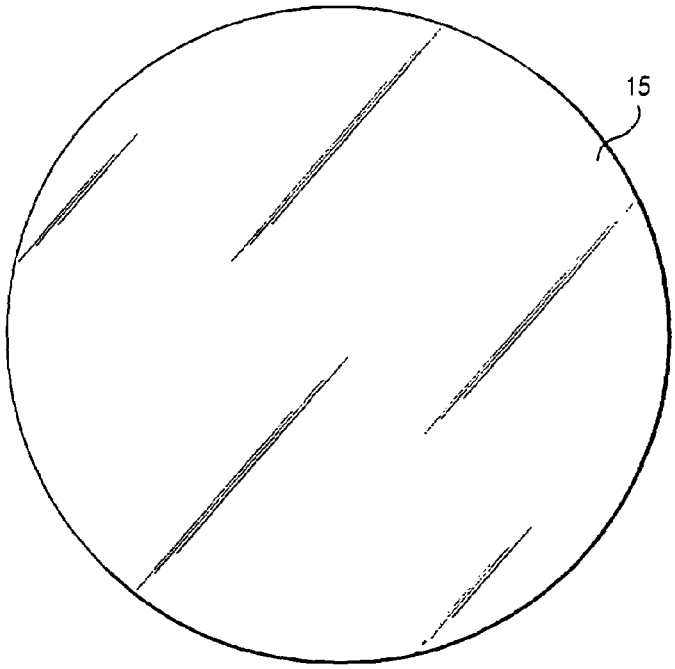
FIGS. 4 and 5 are top plan and side views, respectively, of the lens of the clock of FIG. 1A.
Figure 3:
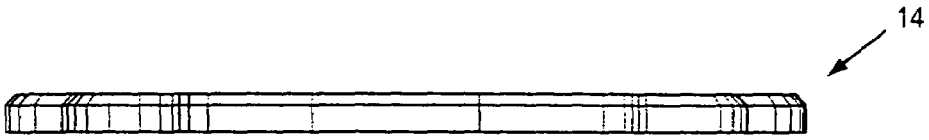
FIG. 3 is a side view of the cover of FIG. 2.
Figure 5:
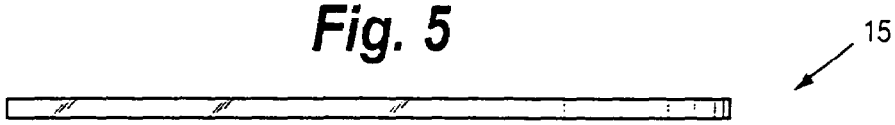

As illustrated in FIG. 2, the cover 14 may have surfaces 26, 27 spaced from each other by a ridge 28 having an inside diameter preferably less than the outside diameter of the lens 15. The ridge 28 preferably engages the top surface of the lens 15 which in turn engages and seals with an O-ring 32. The O-ring 32 may be provided in a channel in the top surface 33 of the casing second portion 12. The O-ring 32 is preferably radially outwardly from the lip 34 mounting the face 16 in the interior of the casing second portion 12, and effectively seals the casing portions 12, 14 (through lens 15) in a water-tight manner. If desired an O-ring may alternatively or additionally be provided on the bottom surface of the cover 14 where it engages the lens 15.

In order to allow the clock 10 to be readily detached from the surface 11, yet positively held in place during use, preferably a conventional ready-release connection is provided between the casing second portion 12 and the first portion/mounting base 13. In the embodiment illustrated in the drawings, particularly FIGS. 7 through 10, this ready-release connection preferably comprises a bayonet connection.

The casing first portion 13 preferably is held to the surface 11 by mechanical fasteners, such as the screws 37 illustrated in FIG. 1A. The screws pass through openings 36 (see FIG. 7) formed in the mounting base 13. Shown substantially concentric with the exterior periphery of the mounting base 13, most clearly in FIG. 7, is a flange mounting ring 38 that mount the flanges 39 of the bayonet connection. The flanges 39 (which may comprise anywhere from two to twelve or more flanges, preferably four as illustrated in the drawings) are spaced a distance 40 from the main portion of the base 13, the spacing 40 corresponding to the approximate depth of the groove that each flange 39 will cooperate with to provide a bayonet connection.

Figure 9:
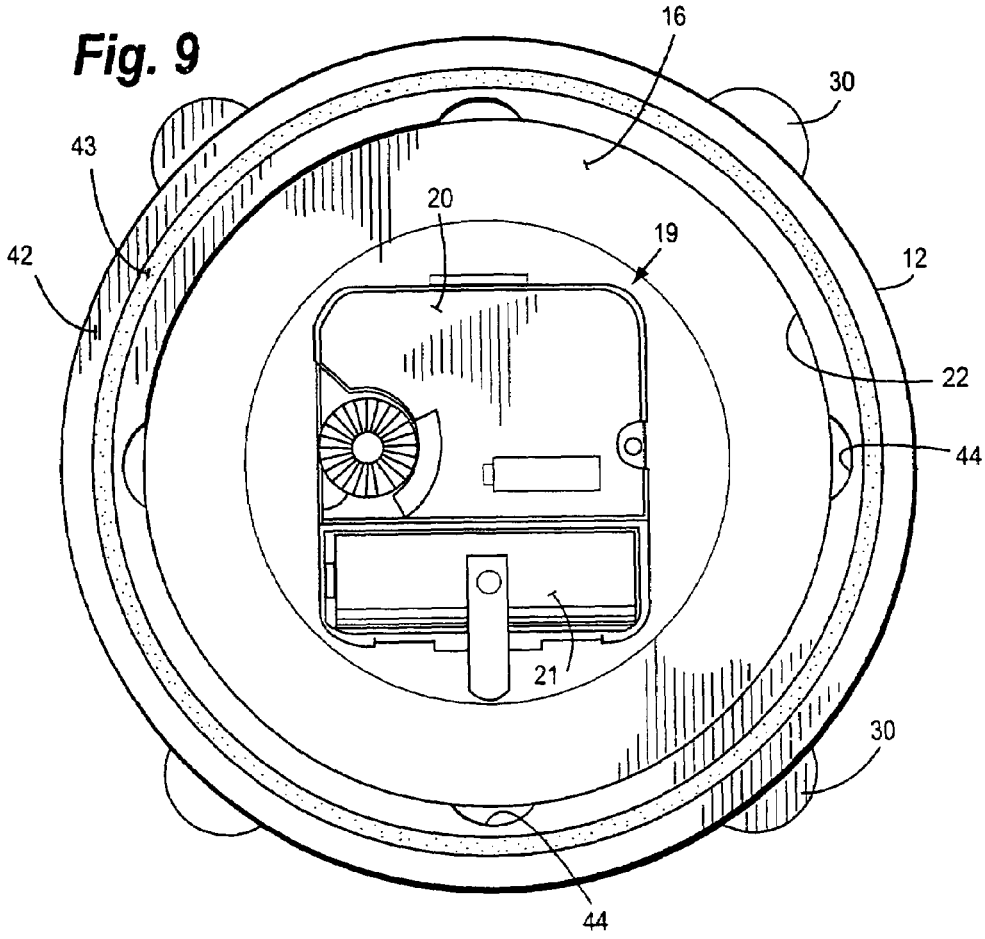
FIG. 9 is a bottom view of the main casing body of the clock of FIGS. 1A and 1B showing the clock movement mounted therein.
Figure 10:
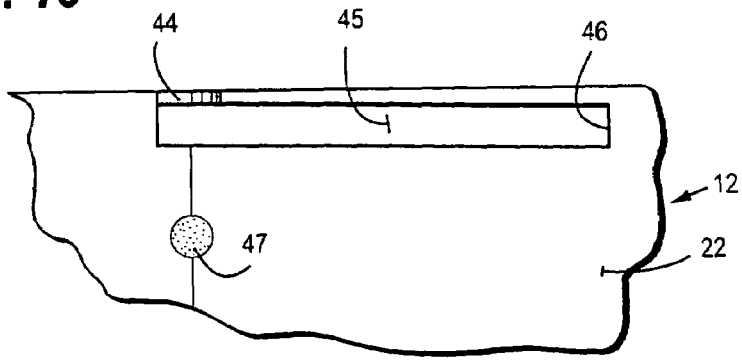
FIG. 10 is a linear development of a portion of the interior wall of the main body portion of the casing of FIG. 9 showing a flange-cooperating groove and porous plastic plug vent.
Figure 11:
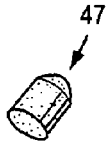
FIG. 11 is a perspective view of the porous plug vent also shown in FIGS. 1B and 10.

As seen in FIG. 9, the bottom surface 42 of the second portion 12 of the casing has a groove formed therein for receipt of another conventional O-ring 43 which is formed radially outwardly of the mounting flange 38 and flanges 39 of the base 13 when the components 12, 13 cooperate. The O-ring 43 is also radially exterior of a number of entrance openings 44 (see FIGS. 9 and 10) provided to grooves 45 (see FIG. 10) in the interior side wall 22 of the casing second portion 12, the entrance openings 44 in the grooves 45 dimensioned and configured to cooperate with the flanges 39 of the base 13. The O-ring 43 is also radially exterior of the entrance openings 44.

In use, with the mounting portion 13 affixed to the surface 11 by the screws 37, the user brings the casing second portion 12 into operative association with the base 13 by aligning the entrance openings 44 with the flanges 39, and then pressing downwardly so that the surface 42 and/or O-ring 43 engage the top surface of the base 13. Then the casing portion 12 is rotated so that the flanges 39 move into the grooves 45, until the stop edges 46 of the grooves 45 are reached. In this position the O-ring 43 provides a substantially water-tight seal for the volume interiorly of the wall 22 of the casing 12 which contains the movement 19. Yet when it is desired to remove the operative components of the clock 10 from the mounting surface 11, all one does is rotate the casing 12 in the opposite direction to that for installation, until the flanges 39 are aligned with the entrance openings 44, and then the casing 12 is pulled outwardly from the surface 11, detaching from the base 13.

In order to ensure effective operation of the movement 19, it is highly desirable to be able to vent the substantially water-tight volume within the casing portion 12 containing the movement 19. However though it is desired to vent that volume, water must be kept out of the volume. This desired result is preferably provided by utilizing a vent which substantially continuously allows passage of air in and out of the volume, but substantially precludes passage of water into the volume under a pressure of at least 12 inches of water (and preferably even under a pressure of about 30 feet of water). The preferred construction of the vent is preferably a simple plug 47 (see FIGS. 1B, 10, and 11) of porous plastic (porous plastic plug 47 is sometimes also referred to as a hydrophobic filter), having a length substantially the same as the thickness of the casing portion 12 wall, a diameter of less than half an inch, and a porosity that allows the passage of air but not water during the normal use conditions of the clock 10. For example (and example only) the porous plastic of the plug 47 may have a porosity of about 1-12 microns (that is an average pore size of between about 1-12 microns). Any conventional porous plastic may be used for the plug 47. While one plug 47 is illustrated in the embodiment shown in the drawings, if desired a plurality of plugs 47 may be provided depending upon the use conditions for the clock 10, the diameter of the face 16, the particular type of movement 19, and other factors.

Figure 13:
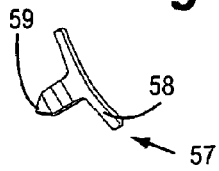
FIG. 13 is a perspective view of the barometer manual indicator of the barometer of FIG. 12.
Figure 12:
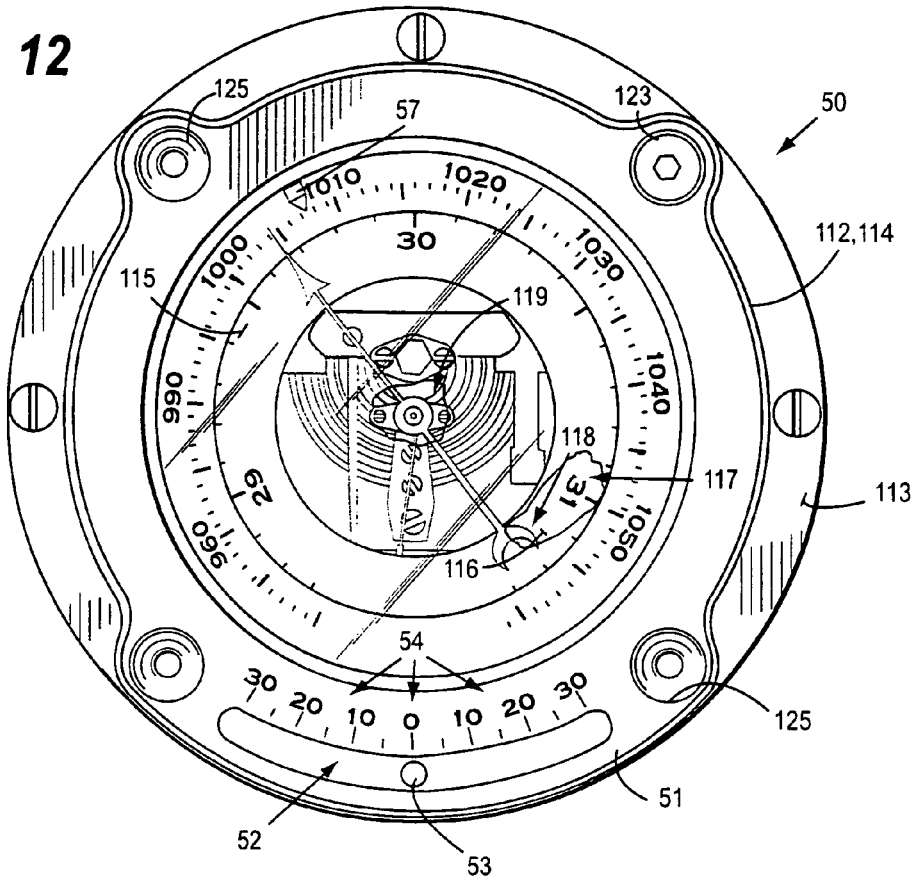
FIG. 12 is a view like that of FIG. 1A only for a barometer.
Figure 14:
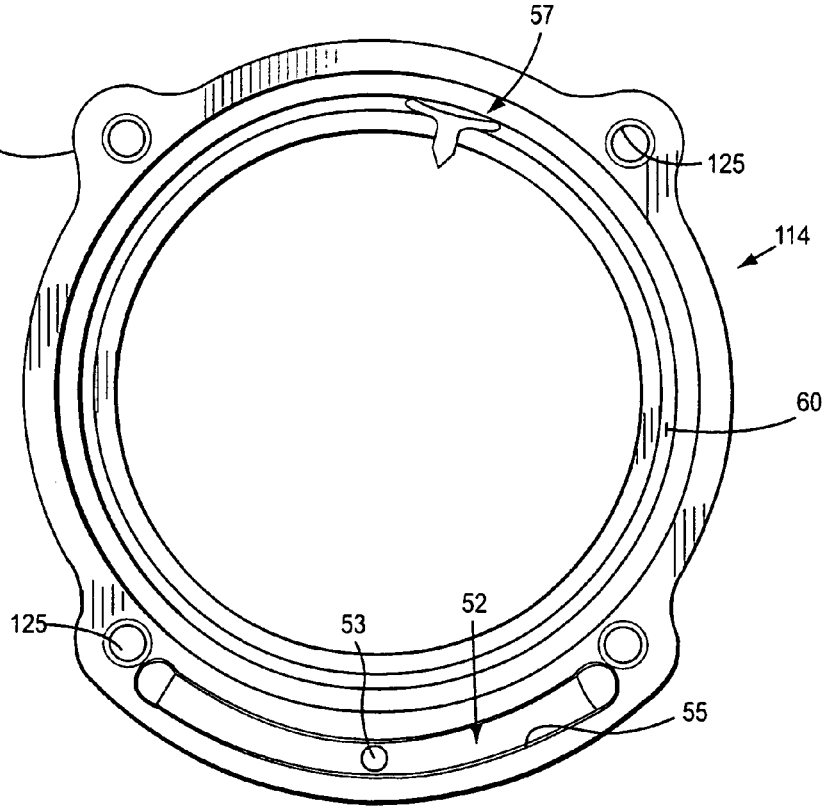
FIG. 14 is a view like that of FIG. 2 of the barometer of FIG. 12.

FIGS. 12 through 14 show another embodiment of an instrument according to the present invention. In the FIGS. 12 through 14 embodiment components comparable to those of the FIGS. 1 through 11 embodiment are shown by the same reference numeral only preceded by a "1".

The instrument 50 (FIG. 12) is a barometer. The movement 119 is in this particular case mechanical, and a single hand 118 may be provided which traverses the barometer indicia 117 on the face 116. However again the movement 119 may be electronic with a digital display then provided instead of the hand 118 and indicia 31.

In the embodiment of FIGS. 12 through 14, an enlarged portion 51 of the cover 114, and cooperating part of the second portion 112, is provided which contains a conventional inclination indicator. While any conventional inclination indicator may be utilized, the one illustrated in FIGS. 12 and 14 is a viscous fluid-filled curved tube having a metal ball 53 therein, with indicia 54 provided on the top surface of the cover 114 corresponding to degrees from horizontal. For example when the ball 53 is aligned with the "zero" indicia 54, a vertical line passing through the barometer 50 and the marine vessel deck with the barometer 50 mounted on a substantially vertical surface 11, is perpendicular to the water, whereas if the ball 53 is at the indicia 20 the marine vessel is listing 200 to one side or the other. As seen in FIG. 14 the conventional inclination indicator 52 is mounted in a contoured groove 55 provided in the bottom of the cover 114.

To facilitate the barometer function of the instrument 50, a manually movable indicator 57 is provided. The indicator 57 has a slide portion 58 and a pointer portion 59 (see FIG. 13). The slide portion 58 is mounted in a substantially circular groove 60 (see FIG. 14) formed in the bottom of the cover 114. During use, with the barometer 50 as illustrated in FIG. 12, the user places his or her finger on the pointer portion 59 of the indicator 57 and provides a pushing force on it, sliding it to a desired position with respect to the indicia 117. Then the user can tell, by comparing the position of the hand 118 with respect to the indicator 57, whether the barometric pressure is rising or falling since the indicator 57 was moved to a particular position with respect to the groove 60.

While the inclination indicator 52 has been illustrated as provided with the barometer 50 version of the instrument according to the invention, it may equally well be provided with a clock 10, a thermometer, or other conventional marine instrument.

It will thus be seen that according to the present invention an instrument highly suitable for use in a marine environment is provided. The casing components are sturdy, readily releasably mounted yet will remain fixed in a position to which they are intentionally moved, and provide substantially complete water tightness yet allow venting. Almost any electrical, electro-mechanical, mechanical, or electronic movement may be provided for the instrument with appropriate cooperating display visible from exteriorly of the instrument. The invention also specifically covers all specific ranges within any broad range; for example water tightness within the range of between about 12 inches-30 feet of water also specifically covers 1.1-5 feet, 5-31 feet, and all other narrower ranges within the broad range.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent devices and instruments.

What is claimed is:

1. A marine instrument comprising:

a face having indicia associated therewith;

an electrical, mechanical, electronic, or electro-mechanical instrument movement;

at least one hand operatively connected to said movement and positioned to move with respect to said face;

a casing water tight to at least about 12 inches of water, said movement, face and at least one hand disposed within said water-tight casing; and a first portion of said casing which facilitates fixing of said casing directly on a surface, and a second portion of said casing which is readily movably mounted with respect to said first portion to allow access to said movement when said first and second portions are in a first position, and precluding access to said movement when said first and second portions are in a second position, wherein a substantially water-tight volume is defined between said first and second portions when in said second position, and further comprising a vent substantially continuously allowing passage of air in and out of said volume but precluding passage of water into said volume under a pressure of at least 12 inches of water.

2. A marine instrument as recited in claim 1 wherein said vent comprises at least one plug of porous plastic.

3. An instrument as recited in claim 1 wherein said movement comprises a battery powered movement, and wherein said face comprises a clock face having clock indicia thereon, and wherein at least two hands are operatively connected to said movement and positioned to move with respect to said face.

4. An instrument as recited in claim 1 wherein said movement comprises a barometer movement, and wherein said face comprises a barometer face having barometer indicia thereon; and further comprising a manually movable indicator cooperable with said barometer face.

5. An instrument as recited in claim 1 further comprising an inclination indicator mounted in said casing adjacent said face and visible from exterior of said casing when viewing said face.

6. A marine instrument comprising:

a face having indicia associated therewith;

an electrical, mechanical, electronic, or electro-mechanical instrument movement;

at least one hand operatively connected to said movement and positioned to move with respect to said face;

a casing water tight to at least about 12 inches of water, said movement, face and at least one hand disposed within said water-tight casing; and a first portion of said casing which facilitates fixing of said casing directly on a surface, and a second portion of said casing which is readily movably mounted with respect to said first portion to allow access to said movement when said first and second portions are in a first position, and precluding access to said movement when said first and second portions are in a second position, wherein said first and second portions of said casing are movably mounted with respect to each other by a plurality of flange and groove connections, and further comprising at least one seal mounted on at least one of said first and second portions for providing a substantially water-tight seal between said first and second portion in said second position.

7. An instrument as recited in claim 6 wherein said at least one seal comprises at least one O-ring radially outward of said flange and groove connections.

8. A marine instrument comprising:

a face having indicia associated therewith;

an electrical, mechanical, electronic, or electro-mechanical instrument movement;

at least one hand operatively connected to said movement and positioned to move with respect to said face;

a casing water tight to at least about 12 inches of water, said movement, face and at least one hand disposed within said water-tight casing; and a first portion of said casing which facilitates fixing of said casing directly on a surface, and a second portion of said casing which is readily movably mounted with respect to said first portion to allow access to said movement when said first and second portions are in a first position, and precluding access to said movement when said first and second portions are in a second position, wherein said casing further comprises a third portion on the opposite side of said second portion from said first portion, and a lens, said lens covering said face and being held in substantially water-tight relationship with at least one of said face and said second portion by said third portion; and wherein said third portion is mounted by a plurality of releasable mechanical fasteners to said second portion.

9. An instrument as recited in claim 8 wherein said first, second, and third casing portions are of aluminum, and wherein said lens is of transparent glass or plastic.

10. A marine instrument comprising:

a face having a display;

an electrical, mechanical, electronic, or electro-mechanical instrument movement, operatively connected to said display;

a casing water tight to at least about 12 inches of water, said movement and face disposed within a substantially water-tight volume of said water-tight casing; and a vent substantially continuously allowing passage of air in and out of said volume but precluding passage of moisture into said volume under a pressure of at least 12 inches of water.

11. An instrument as recited in claim 10 wherein said vent comprises at least one plug of porous plastic.

12. An instrument as recited in claim 10 wherein said casing is water-tight, and said vent precludes passage of water into said volume, to at least a pressure of about 30 feet of water.

13. An instrument as recited in claim 10 wherein said casing comprises first, second, and third portions, said portions sealed to each other by O-ring seals, with said second portion between said first and third portions, and wherein said second portion is substantially tubular.

14. An instrument as recited in claim 13 wherein said first and second portions are readily releasably held together by a plurality of flanges and grooves, and wherein said second and third portions are held together by releasable mechanical fasteners.

15. A marine instrument comprising:

a face having a display;

an electrical, mechanical, electronic, or electro-mechanical instrument movement;

a casing water tight to at least about 12 inches of water and comprising a body portion, a cover portion, and a lens portion;

said casing body portion containing therein or mounting thereon said movement and face; and said casing body portion covered by said lens portion and said cover portion, and said cover portion holding said lens portion in contact with said body portion making a substantially water-tight seal with said body portion, and said face and display visible from outside said casing through said lens, wherein said substantially water-tight seal between said body portion and said cover and lens portions is provided by at least one O-ring seal.

16. An instrument as recited in claim 15 wherein said movement comprises a barometer movement, and wherein at least one of said face and said display comprises barometer indicia.

17. An instrument as recited in claim 15 further comprising an inclination indicator mounted in said casing adjacent said face and visible from exterior of said casing when viewing said face.

18. An instrument as recited in claim 15 wherein said movement comprises a battery powered clock movement, and wherein said face comprises a clock face having clock indicia thereon, and further comprising at least two hands movable with respect to said face clock indicia.

* * * * *